United States Patent [19]

Marsh et al.

[11] 4,281,782

[45] Aug. 4, 1981

[54] BUTTON SEWING DEVICE

[75] Inventors: Walter H. W. Marsh, Scotch Plains; Michael J. Brienza, Ridgewood, both of N.J.

[73] Assignee: The Singer Company, Stamford, Conn.

[21] Appl. No.: 191,962

[22] Filed: Sep. 29, 1980

[51] Int. Cl.[3] ..... D05B 85/00; D05B 3/14

[52] U.S. Cl. ..... 223/102; 112/110; 227/68

[58] Field of Search ..... 112/110, 80; 223/102; 227/68

[56] References Cited

U.S. PATENT DOCUMENTS

| | | | |
|---|---|---|---|
| 1,343,289 | 6/1920 | Suchy | 227/68 |
| 1,674,544 | 6/1928 | Hertelewdy | 223/102 |
| 2,133,916 | 10/1938 | Churchill | 227/68 X |
| 2,513,633 | 7/1950 | Folson | 112/110 X |
| 2,605,943 | 8/1952 | Hoefle | 223/102 |
| 2,767,670 | 10/1956 | Serbeck | 223/102 X |
| 4,111,347 | 9/1978 | Bone | 227/68 |

*Primary Examiner*—H. Hampton Hunter

*Attorney, Agent, or Firm*—William V. Ebs; Robert E. Smith; Edward L. Bell

[57] ABSTRACT

A button sewing device is provided with a base; a pair of needles which carry collapsible thread formed loops, and project from the base for use in penetrating a layer of material and the holes of a button to be attached to the material; and with elastomeric material over the base compressible by pressure on the material to which the button is to be attached, and expandable to raise such material and thereby cause the loops to be opened above the button for receiving a thread bundle.

11 Claims, 9 Drawing Figures

BUTTON SEWING DEVICE

DESCRIPTION

BACKGROUND OF THE INVENTION

1. Field of the Invention

The invention is directed to a device which facilitates the attachment of a button to a fabric or other material.

2. Description of the Prior Art

Button attaching aids, of which the devices shown and described in U.S. Pat. No. 2,605,943 of A. O. Hoefle issued Aug. 5, 1952, and the apparatus disclosed in U.S. Pat. No. 4,111,347 of Arnold R. Bone issued Sept. 5, 1978 are examples, are well known. However, button attaching aids have been deficient in various respects. In general they have been difficult to thread, performed unreliably, and were inefficient, or were unduly complex and costly to produce. Recent improvements in button attaching aids are disclosed in Singer owned U.S. Patent application Ser. No. 145,939 filed May 2, 1980 by Donald R. Davidson et al for "Button Attaching Tool", and in another Singer owned U.S. Patent application Ser. No. 167,984, July 14, 1980, of Donald R. Davidson et al for "Button Attaching Tool With Button Storage Compartment". The button attaching aids of said applications overcome to a degree, the various deficiencies present in the prior art device, and the present application further improves upon such designs by providing a button sewing device which is especially simple in construction and far less costly to produce than anything heretofor proposed.

SUMMARY OF THE INVENTION

In accordance with the invention, a button attaching tool is provided with a base and a pair of needles projecting from the base for use in penetrating a layer of material and the holes of a button to be attached to the material. A loop of thread extends through the eye of each needle and has ends affixed with respect to the needle. Each loop can collapse on passing through the material and the holes in a button. The thread is formed of one or more natural fiber filaments or of one or more plastic filaments. Elastomeric material is provided over the base and around the needles to engage the material to which the button is to be attached. The elastomeric material is compressible by pressure on the material to which the button is to be attached and is expandable to raise such material and cause the threads to open collapsed loops above the button for receiving a button attaching thread bundle.

DESCRIPTION OF THE INVENTION

Figure 1:
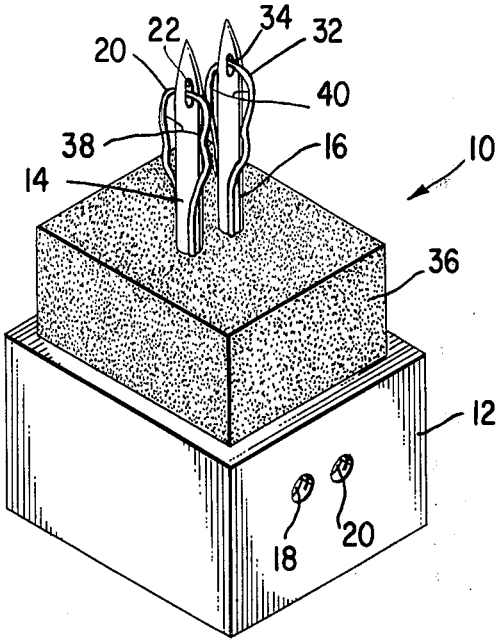
FIG. 1 is a perspective view of a button sewing device according to the invention.
Figure 2:
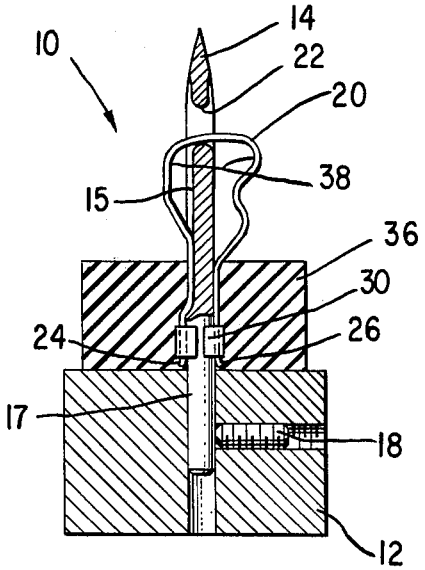
FIG. 2 is a vertical sectional view taken on a plane through a needle of the device.
Figure 3:
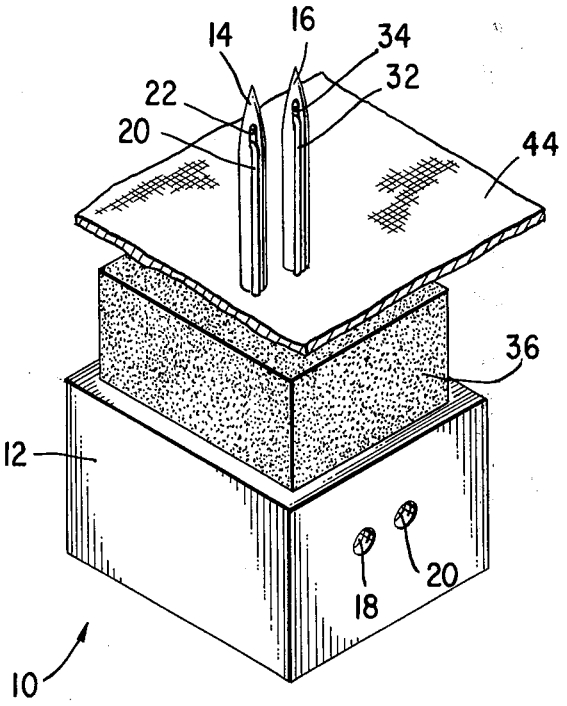
FIG. 3 is a perspective view showing a layer of fabric in place in needles of the device.
Figure 4:
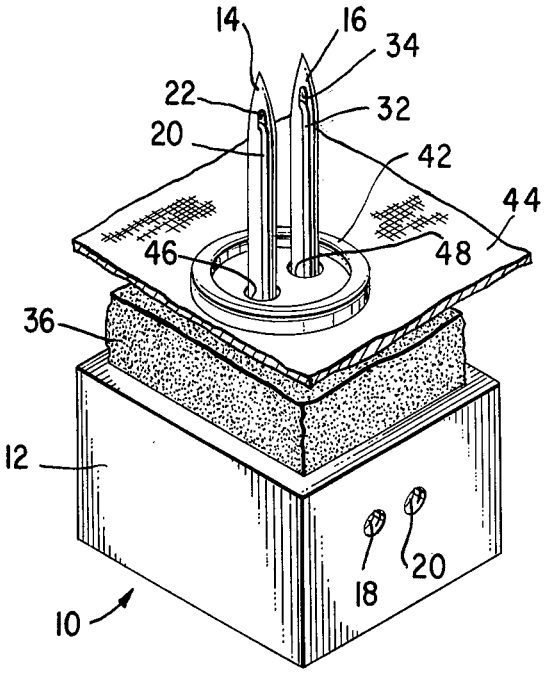
FIG. 4 is a perspective view of the device showing the fabric pressed downwardly against compressible material with a button.

Referring to FIGS. 1 through 8 of the drawings, reference character 10 designates a button sewing device according to the invention including a base 12 and a pair of needles 14 and 16 secured in the base as by set screws 18 and 20 or in any other suitable manner. The needles 14 and 16 carry loose loops of thread which extend through the eyes of the needles and have ends secured to needles near the base of the device. As shown, needle 14 carries thread 20 extending through eye 22 and having ends 24 and 26 secured to the needle with a crimped ring 30. Needle 16 carries a thread 32 which extends through eye 34 and has ends secured to the needle in the same manner as the ends of thread 20 are secured to needle 14. One side of needle 14 includes a straight thread receiving groove 15 which extends downwardly from eye 22 to a bottom portion 17 of the needle. Needle 16 includes a like thread receiving groove. An elastomeric material 36 is provided about the needles 14 and 16 and is secured to the base 12 as with an adhesive.

Each of the threads 20 and 32 consists of one or more filaments formed of a pliable material enabling loops 38 and 40 formed by the threads 20 and 32 respectively, to be readily collapsed. The filaments may be plastic or composed of natural fibers. The elastomeric material 36 may be foam rubber, a polyurethane plastic, or some other material compressible with finger pressure and capable of returning to its original shape when released.

Figure 5:
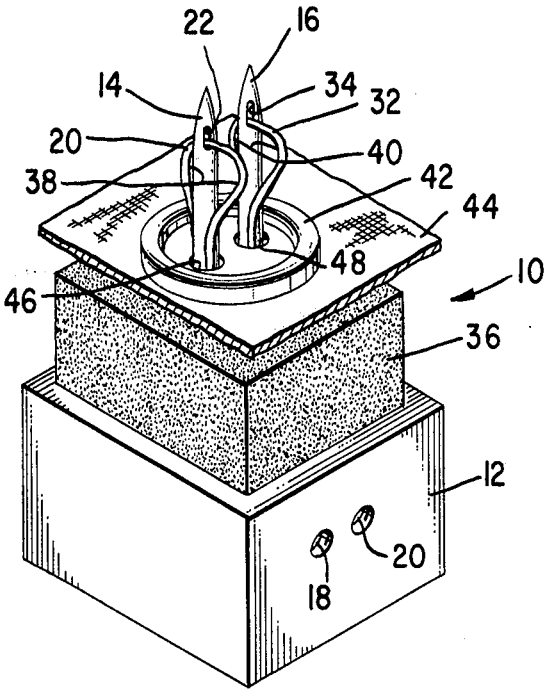
FIG. 5 is a view similar to FIG. 4 showing the button and fabric released.

The button sewing device 10 is utilized to attach a button 42 to a layer of cloth 44 by an operator first forcing the cloth down over the needles 14 and 16 and into a position substantially against elastomeric material 36. As the cloth is moved down the needles, the threads 20 and 32 pass through the cloth. The threads are drawn taut and the loops 38 and 40 are closed (see FIG. 3). Thread 20 enters groove 15 in one side of needle 14 and thread 32 enters the like groove in needle 16. After the cloth has been moved down the needles, button 42 is disposed with holes 46 and 48 therein in alignment with the needles 14 and 16, and is moved down the needles to the cloth. The button is pressed downwardly against the cloth with finger pressure so as to compress the elastomeric material 36 (FIG. 4) and is then released (FIG. 5). As finger pressure is released the elastomeric material expands to its original shape and loops 38 and 40 are opened in the threads 20 and 32 by the cloth as it is moved upwardly. The loops open primarily only on the side of the needles opposite from the grooved sides because of the tendency of the threads to remain in the grooves.

Figure 6:
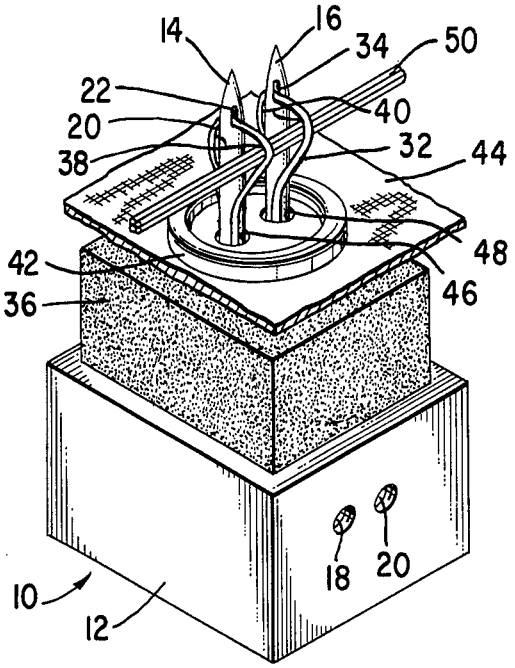
FIG. 6 is a view similar to FIG. 5 showing a thread bundle through thread loops on the device.
Figure 7:
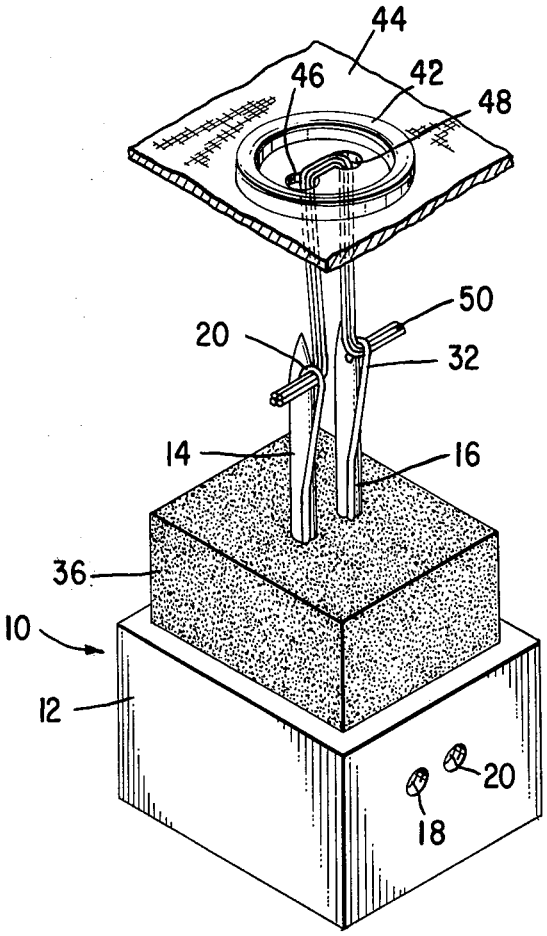
FIG. 7 is a perspective view showing the fabric and button being stripped from the device.
Figure 8:
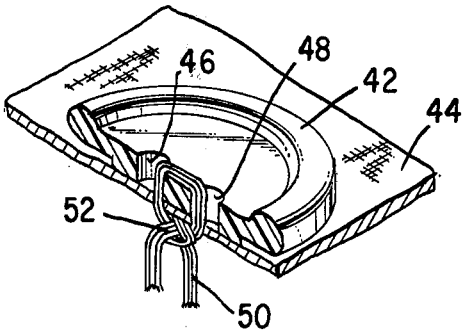
FIG. 8 is an enlarged perspective view showing the button and fabric after having been removed from the device.

While the loops 38 and 40 are open and the button 42 is on the cloth, a bundle of threads 50 is threaded through the loops where it is temporarily held (FIG. 6). The cloth 44 and button 42 are then pulled from the needles 14 and 16 with one hand while the base 12 is held with the other hand, and in the process the thread bundle 50 extending through the loops 38 and 40 is pulled through holes 46 and 48 in the button 42, and through the cloth 44 (FIG. 7). After removal of the button and cloth from the device 10, end portions of the thread bundle may be tied into a knot 52 to permanently secure the button to the cloth (see FIG. 8), following which loose hanging thread ends would be cut away.

Figure 9:
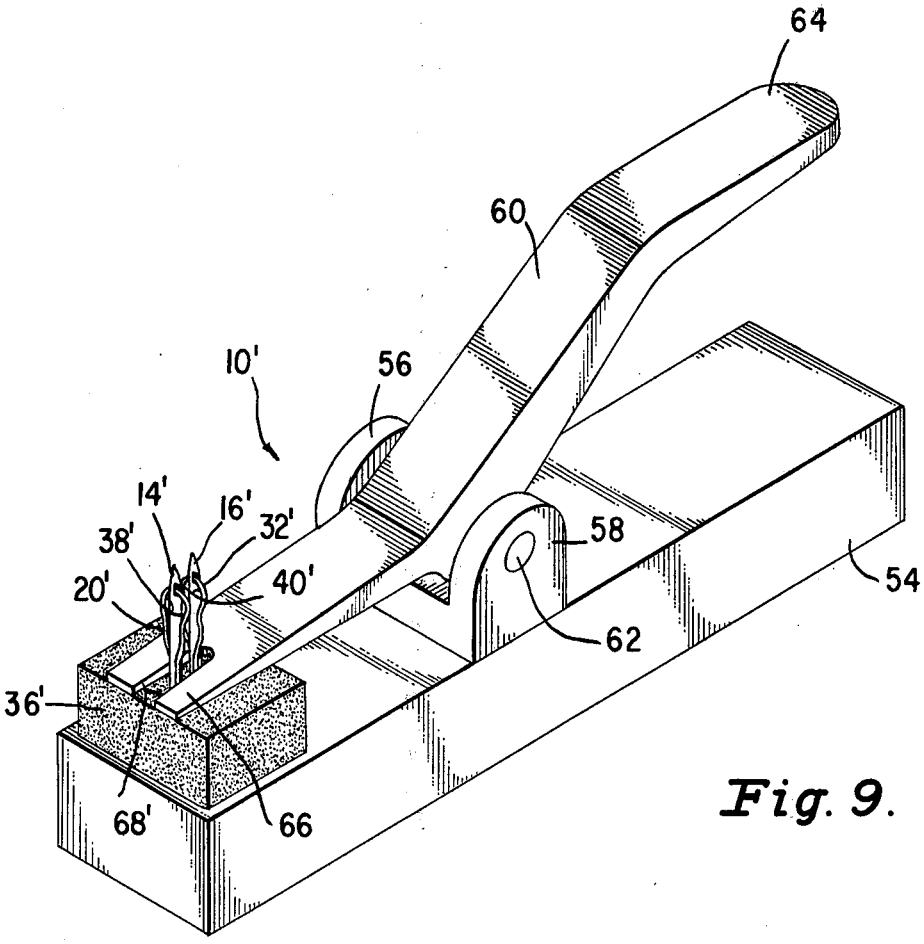
FIG. 9 is a perspective view showing the device modified to include a manually operable stripping lever.

The operation of a device as described may be facilitated with the provision of a stripping lever in a construction as shown in FIG. 9 wherein parts corresponding to those already shown and described have been designated with like reference characters having a prime mark (′) added thereto. In the construction of FIG. 9 device 10′, includes needles 14′ and 16′ which carry loop forming thread 20′ and 32′, and includes a support base 54 for an elastomeric material 36′. The support base 54 includes trunnions 56 and 58 wherein a stripping lever 60 is pivotally mounted on a pin 62. The stripping lever may be moved with a handle 64 at one end to dispose the opposite end 66 in a position as shown where the needles 14′ and 16′ extend through a slot 68 in the lever and the elastomeric material 36′ is engaged by the lever. The stripping lever may also be moved with handle 64 to raise end 66 above the needles.

The construction of FIG. 9 is used in a similar manner to device 10 already described. However, the cloth to which a button is to be attached, and the buttons are threaded onto the needles while end 66 of lever 60 is against elastomeric material 36′. Pressure is applied to the button to compress the elastomeric material and is then released to provide for the formation of loops 38′ and 40′ in thread 20′ and 32′ respectively. A thread bundle is inserted through the loops and the handle is operated to lift the button and material off the needles. The button and material are removed by hand from the device and the thread bundle which is thereby extracted from the thread loops is tied into a knot to permanently secure the button to the cloth.

It is to be understood that the present disclosure relates to preferred embodiments of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. A button sewing device comprising a base; a pair of needles projecting from the base for use in penetrating a layer of material and extending through the holes of a button to be attached to the material, a loose loop of thread extending through the eye of each needle and having ends fixed with respect to the needle, the thread being movable by the material into positions against the needles to close the loops as the material is moved down the needles; and elastomeric material over the base and about the needles compressible under the material by pressure applied to the button after it has been moved down the needles, and expandable when the pressure is removed for raising the material and thereby the thread to open the loops above the button for receiving a thread bundle.

2. A button sewing device according to claim 1 wherein said thread ends are affixed on the needles.

3. A button sewing device according to claim 1 including a ring on each needle wherein said thread ends are secured.

4. A button sewing device according to claim 1 wherein the compressible elastomeric material is foam rubber.

5. A button sewing device according to claim 1 wherein the compressible elastomeric material is a polyurethane plastic.

6. A button sewing device according to claim 1 wherein the thread is a plastic filament.

7. A button sewing device according to claim 1 wherein the thread is composed of a plurality of plastic filaments.

8. A button sewing device according to claim 1 wherein the thread is a natural fiber filament.

9. A button sewing device according to claim 1 wherein the thread is composed of a plurality of natural fiber filaments.

10. A button sewing device according to claim 1 including a ring on each needle crimped about the needle and over the thread ends of the loop of thread on the needle to thereby secure the thread ends to the needle.

11. A button sewing device according to claim 1 including a longitudinally extending groove on one side of each needle to retain thread and permit the loops to open primarily on the opposite sides of the needles during expansion of the compressible material.

* * * * *